US005867830A

United States Patent [19]

Chen

[11] Patent Number: 5,867,830

[45] Date of Patent: Feb. 9, 1999

[54] SMOOTHLY MANIPULATABLE WRINKLE-FREE GLOVE FOR GOALKEEPER

[76] Inventor: Yi-Yi Chen, 248, Lane 48, San-Chiao Rd., Sec. 1, Yen-Lin, Chang-Hua, Taiwan

[21] Appl. No.: 79,886

[22] Filed: May 15, 1998

[30] Foreign Application Priority Data

Aug. 29, 1997 [CN] China ..... 97225522.2

[51] Int. Cl.[6] ..... A41D 19/00

[52] U.S. Cl. ..... 2/161.1; 2/159

[58] Field of Search ..... 2/158, 159, 160, 2/161.1, 161.6, 161.3, 161.8, 162, 169

[56] References Cited

U.S. PATENT DOCUMENTS 1,823,307 9/1931 Wickman et al. ..... 2/161.6
2,012,869 8/1935 Dickson ..... 2/161.6
3,997,922 12/1976 Huhta ..... 2/161.1
5,581,809 12/1996 Mah ..... 2/161.1
5,727,257 3/1998 Chen ..... 2/161.1
5,774,896 7/1998 Hochmuth ..... 2/161.1

*Primary Examiner*—Amy Vanatta

[57] ABSTRACT

A goalkeeper's glove includes: a wrinkle-releasing slot formed in a palm side of the glove for relieving any wrinkles formed when bending or curving the glove when grasping a football for well manipulating the catching of the football; an adjustable fastening strap formed on a wrist portion of the glove consisting of a first Velcro hook and loop tape and a second Velcro tape which are adjustably fastened on the wrist portion respectively corresponding to a fat or a slim goalkeeper's hand (wrist) for a comfortable wearing of the glove; and an extending flap protruding downwardly from a palm side of the glove having an anti-slipping pad fixed on the extending flap for holding a football in cooperation with a smooth surface as effected by the wrinkle-releasing slot formed in the palm side of the glove for manipulation of the football.

7 Claims, 6 Drawing Sheets

SMOOTHLY MANIPULATABLE WRINKLE-FREE GLOVE FOR GOALKEEPER

BACKGROUND OF THE INVENTION

A conventional goalkeeper's glove is generally made of elastomer such as latex or Neoprene artificial leather having thickness of 3 mm. Such a thick glove when worn by a goalkeeper may affect his or her manipulability because a bending or curving glove may produce wrinkles especially on the palm side of the glove when grasping a football. Meanwhile, a goalkeeper's glove includes a fixed wrist strap, lacking of adjustment for properly matching a fat or a slim goalkeeper's hand and thereby easily causing wearing uncomfortableness for the goalkeeper.

The present inventor has found the drawbacks of the conventional goalkeeper's glove and invented the present glove with wrinkle-free and smooth manipulation.

SUMMARY OF THE INVENTION

The object of the present invention is to provide a goalkeeper's glove including: a wrinkle-releasing slot formed in a palm side of the glove for relieving any wrinkles formed when bending or curving the glove when grasping a football for well manipulating the catching of the football; an adjustable fastening strap formed on a wrist portion of the glove consisting of a first Velcro® tape and a second Velcro® tape which are adjustably fastened on the wrist portion respectively corresponding to a fat or a slim goalkeeper's hand (wrist) for a comfortable wearing of the glove; and an extending flap protruding downwardly from a palm side of the glove having an anti-slipping pad fixed on the extending flap for well holding a football in cooperation with a smooth surface as effected by the wrinkle-releasing slot formed in the palm side of the glove for well manipulation of the football.

DETAILED DESCRIPTION

Figure 3:
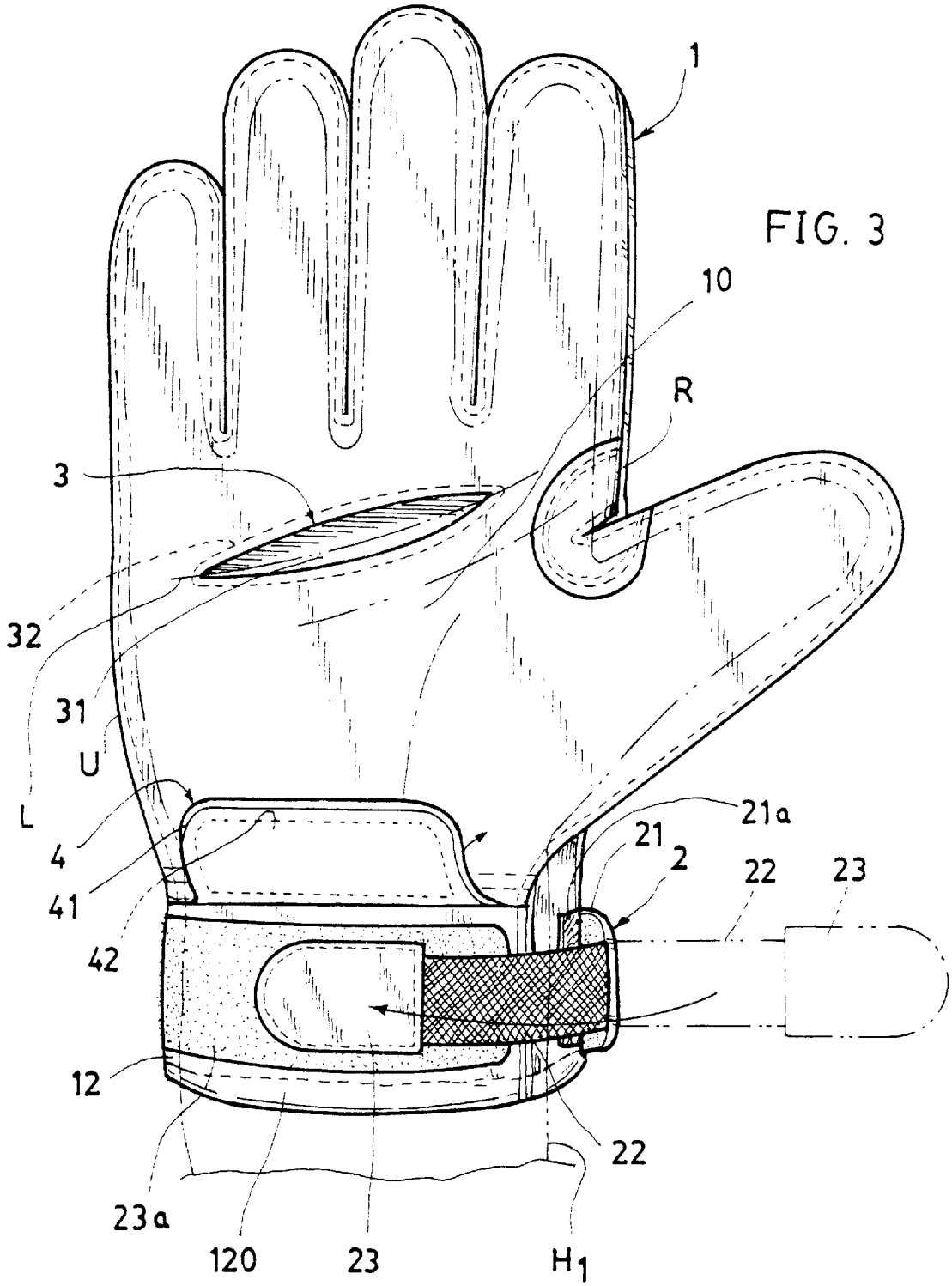
FIG. 3 shows the present invention when fastened on a fat wrist.

As shown in the drawing figures, the present invention comprises: a glove 1 consisting of a palm portion 10 and a back side portion 11 disposed on opposite sides of the glove, a fastening strap 2 secured to a wrist portion 12 of the glove 1, a wrinkle-releasing slot 3 formed in a palm portion 10 of the glove 1 as shown in FIG. 3, and an extending flap 4 protruding downwardly from the palm portion 10 to partially cover the fastening strap 2.

The glove 1 for goalkeeper may be made of elastomer materials having thickness of 3 mm (or even thicker) and good elasticity, such as: latex or Neoprene artificial leather for absorbing the vibrational shock or impact force when "catching" a football for protecting the goalkeeper's hand or for preventing rebound of the ball when hit to the glove 1.

The wrinkle-releasing slot 3 is formed as a slim eye shape and is oriented in a direction generally aligned with a line of hand L across the hand from the radial side R to the ulnar side U of one's hand, having a soft inner lining 31 stitched under the slot 3 by threads 32 as shown in FIG. 3. The inner lining 31 may be selected from: fiber cloth, soft plastic leather, or any other lining materials, not limited in the present invention.

Figure 5:
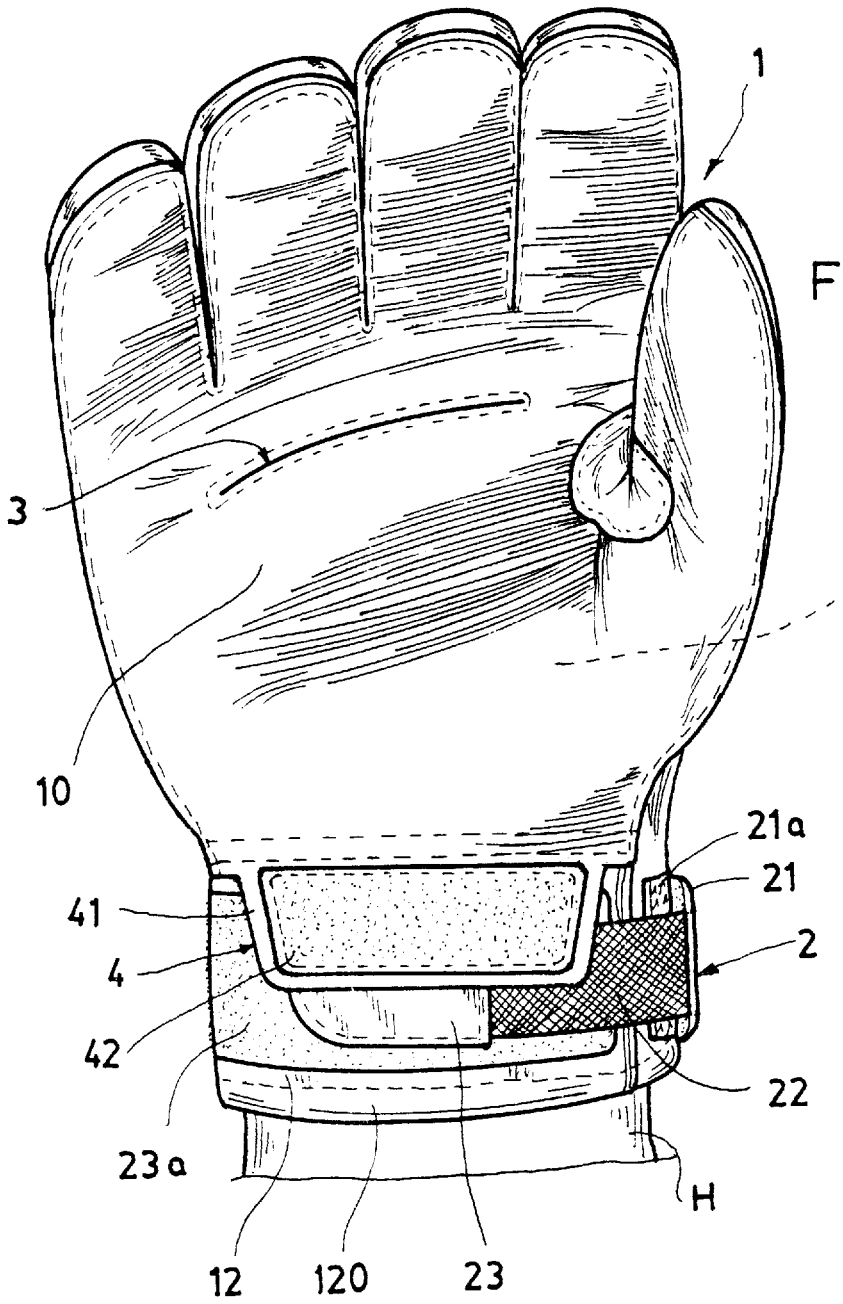
FIG. 5 is an illustration of the present invention when bending the palm portion.

After bending, twisting, folding or curving the glove 1 of the present invention, the slot 3 will relieve the wrinkles or bulges formed on the palm portion of the glove to prevent the wrinkles for ensuring a smooth surface (FIG. 5) for catching the football for a goalkeeper for enhancing a free manipulability on the ball.

The wrinkle-releasing slot 3 may be oriented in a direction corresponding to the lines of a hand; the orientations, numbers and shapes of the slot 3 being not limited in the present invention.

The fastening strap 2 is secured to the wrist portion 12 of the glove 1 adjacent to a cuff of the glove, and is made of materials having good elasticity and stretchable ductility.

Figure 1:
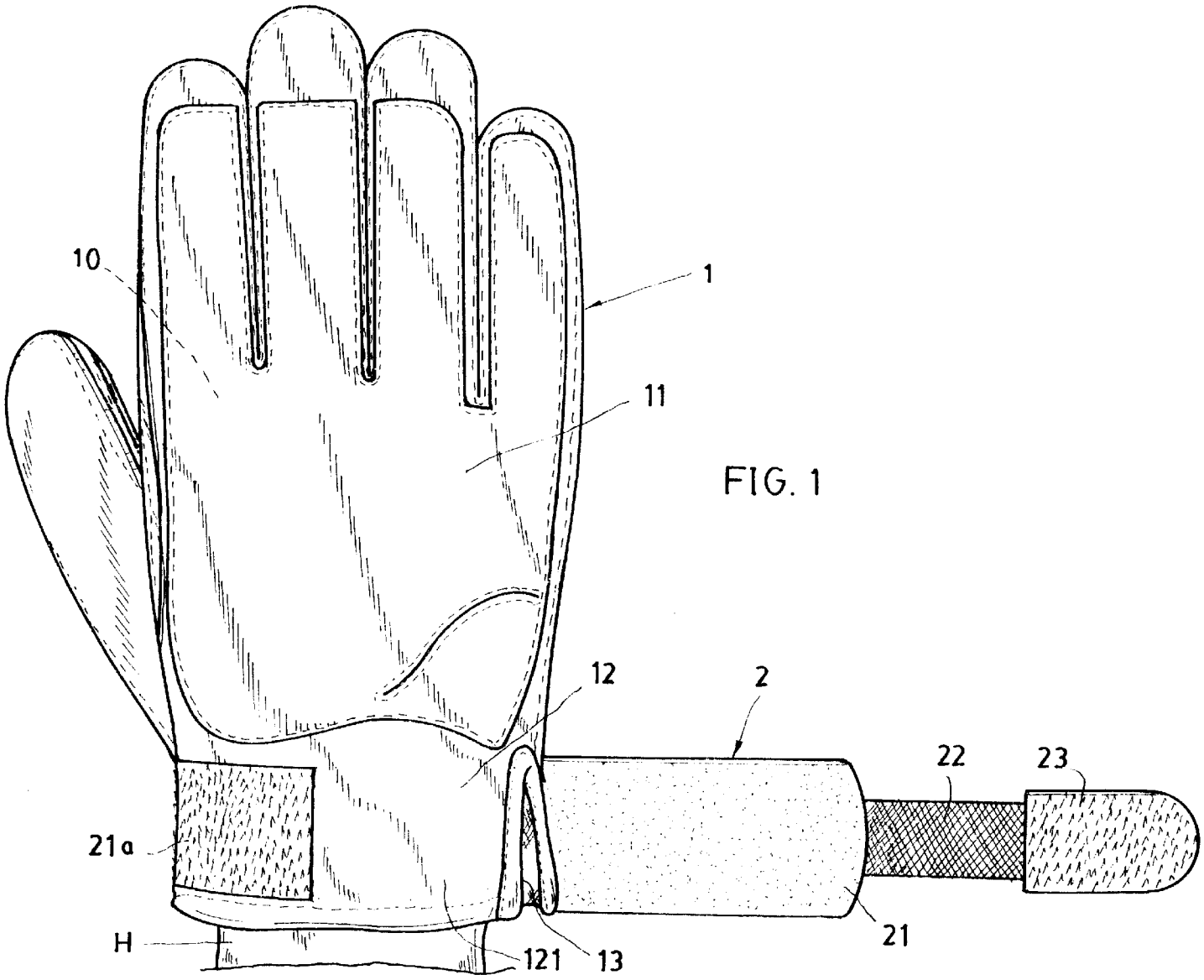
FIG. 1 is a back view of the present invention when the fastening strap is unfastened.
Figure 2:
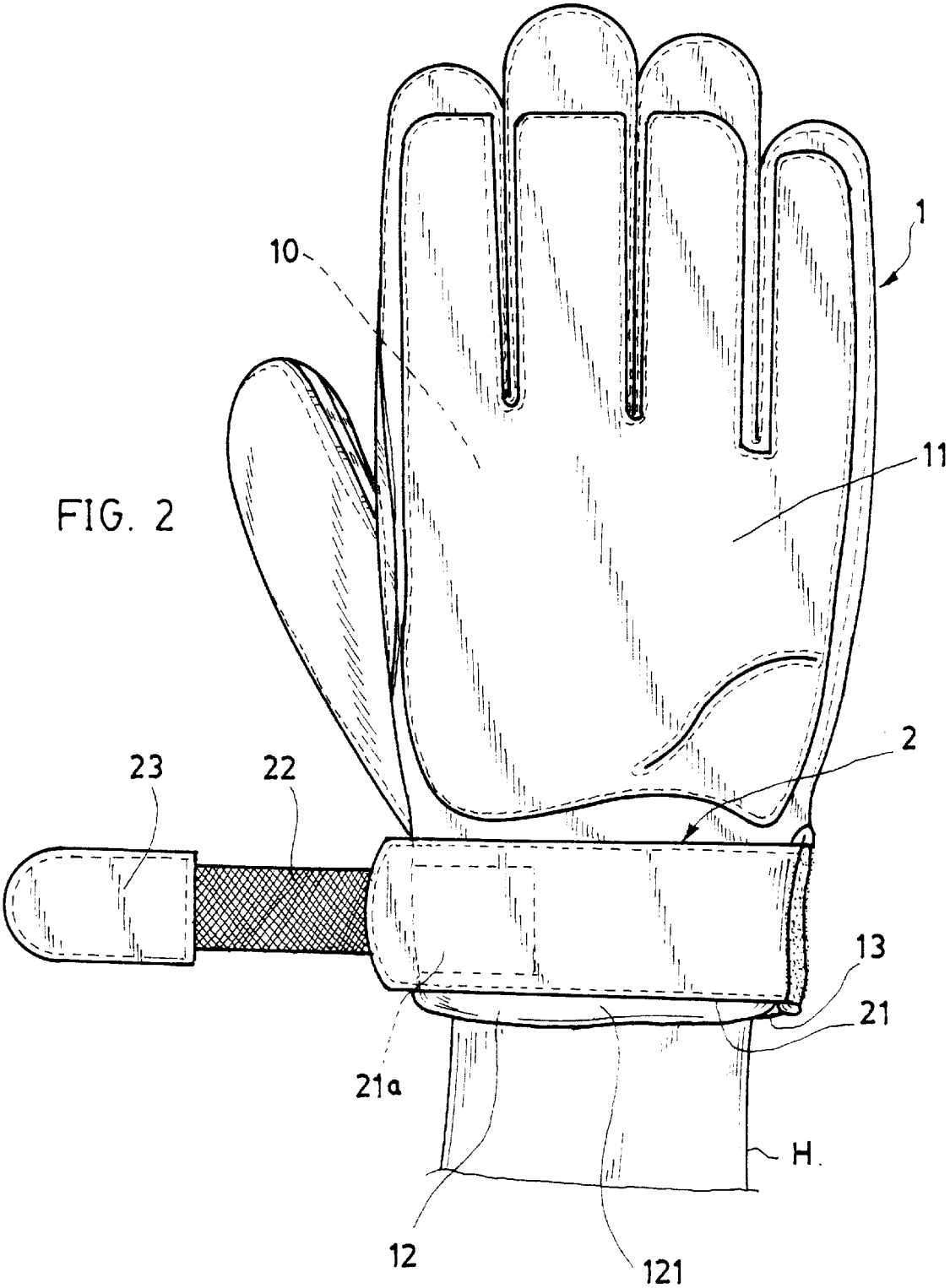
FIG. 2 shows a fastening of the fastening strap on the wrist portion of the glove as derived from FIG. 1.
Figure 4:
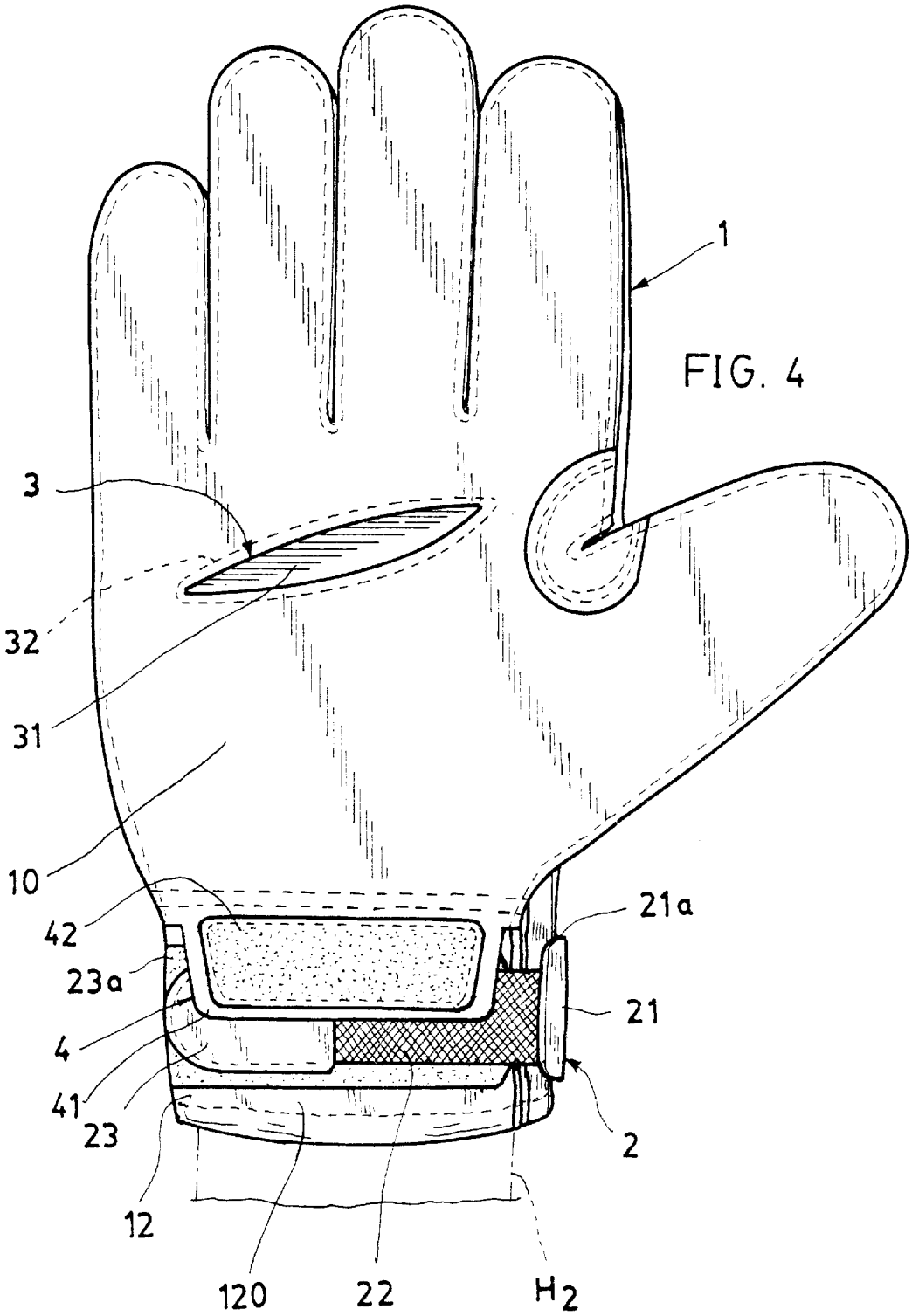
FIG. 4 shows the present invention when fastened on a slim wrist.

The fastening strap 2 includes: a first tape 21 secured to the wrist portion 12 of the glove 1 contiguous to a V-shaped opening 13 formed in the wrist portion 12, having a coarse-surface layer of a Velcro hook and loop tape formed on an inside surface of the first tape 21 to be engageable with (or fastened to) a tiny hook-threads layer 21*a* formed on a back wrist portion 121 of the back side portion 11 of the glove 1 as shown in FIGS. 1, 2; and a second tape 23 secured to the first tape 21 through an elastic fastener 22 as spaced between the first tape 21 and the second tape 23, having a tiny hook-threads layer (of a Velcro tape) formed on an inside surface of the second tape 23 to be engageable with (or fastened to) a coarse-surface layer 23*a* formed on an inside wrist portion 120 of the palm portion 10 as shown in FIGS. 3, 4.

As shown in FIG. 3, the second tape 23 may be engaged on a right (near) side of the coarse-surface layer 23*a* for wearing the glove 1 of the present invention on a fat hand H1; while the second tape 23 may be attached to a left (far) side of the layer 23*a* as shown in FIG. 4 for wearing the glove on a slim hand H2.

When fastening the first and second tapes of the present invention, the strap 2 may be wound in a direction from a back side portion 11 towards a palm portion 10 of the glove as shown in FIGS. 1–3 (or 4). Since the fastening strap 2 may be adjustable for a fat or a slim hand of the goalkeeper, the glove 1 of the present invention can thus be worn more comfortably.

The first and second tapes 21, 23 may be modified to be other fasteners fastened on the wrist portion of the glove, not limited to the Velcro tape as afore-mentioned.

The extending flap 4 may be attached to the palm portion 10 of the glove 1 or integrally formed with the palm portion. So, the flap 4 may be made of the same material as that of the palm portion 10 of the glove.

Figure 6:
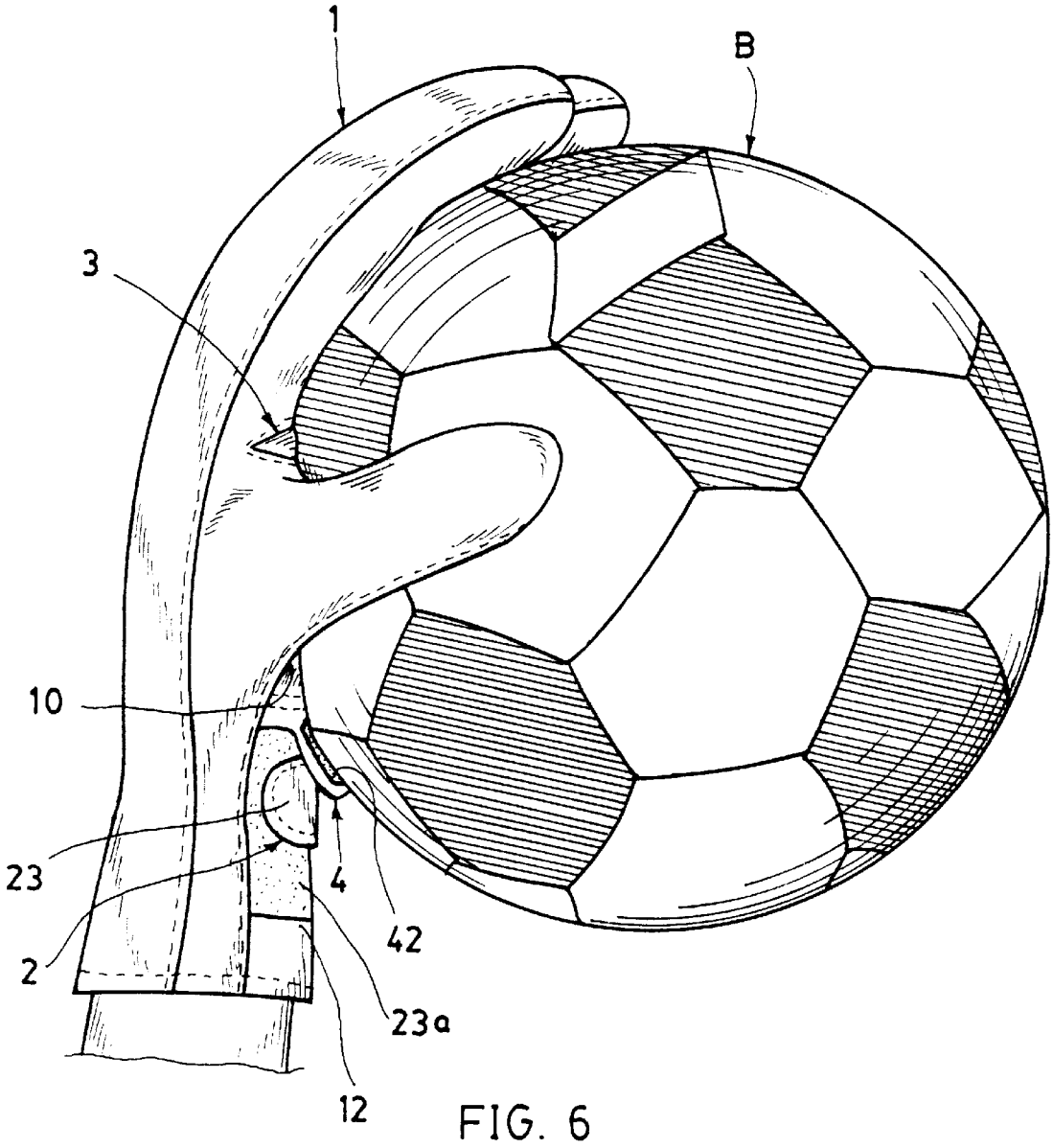
FIG. 6 is an illustration of the present invention when manipulatively grasping a football.

The extending flap 4 includes: a substrate sheet 41 protruding downwardly from the palm portion 10 to partially cover or shield the strap 2; and an anti-slipping pad (or cloth) 42 fixed or adhered on the substrate sheet 41, whereby upon catching of a football on the palm portion 10 of the glove 1, the anti-slipping pad 42 may frictionally hold the ball B in cooperation with the wrinkle-releasing slot 3 having no wrinkle formed on the palm portion 10 as shown in FIG. 6 for increasing the surface area to effectively "catch" the ball without loosening or slipping of the ball from the glove.

So, this invention may enhance the manipulability of a football by a goalkeeper.

Naturally, the present invention is not limited for use by a goalkeeper of football. Other kinds of ball games can also be applicable by using the glove of the present invention.

The present invention may be modified without departing from the spirit and scope of the present invention.

I claim:

1. A goalkeeper's glove comprising:

a glove (1) having a palm portion (10) and a back side portion (11) disposed on opposite sides of the glove (1);

a wrinkle-releasing slot (3) formed in the palm portion (10) of the glove (1) for relieving wrinkles when bending or curving the palm portion (10) of the glove (1);

a fastening strap (2) secured to a wrist portion (12) of the glove (1) for fastening the wrist portion (12) of the glove (1) on a goalkeeper's hand; and an extending flap (4) protruding downwardly from the palm portion (10) of the glove (1) for frictionally catching a football when hit to the glove (1).

2. A goalkeeper's glove according to claim 1, wherein said fastening strap (2) is made of elastic and stretchable material to be fastened on the wrist portion (12) of the glove (1).

3. A goalkeeper's glove according to claim 1, wherein said wrinkle-releasing slot (3) is formed as a slim eye shape, having an inner lining (31) stitched under the slot (3).

4. A goalkeeper's glove according to claim 3, wherein said inner lining (31) is selected from a fiber cloth, a soft plastic leather and a soft sheet material.

5. A goalkeeper's glove according to claim 1, wherein said wrinkle-releasing slot (3) as formed in the palm portion (10) is oriented in a direction generally aligned with a line of a hand across the hand from a radial side to an ulnar side of the hand.

6. A goalkeeper's glove according to claim 1, wherein said fastening strap (2) includes: a first tape (21) secured to the wrist portion (12) of the glove (1) contiguous to a V-shaped opening (13) formed in the wrist portion (12), having a coarse-surface layer of a hook and loop tape formed on an inside surface of the first tape (21) to be engageable with a tiny hook-threads layer **(21*a*) formed on a back wrist portion (121) of the back side portion (11) of the glove (1); and a second tape (23) secured to the first tape (21) through an elastic fastener (22) as spaced between the first tape (21) and the second tape (23), having a tiny hook-threads layer of a hook and loop tape formed on an inside surface of the second tape (23) to be engageable with a coarse-surface layer (23*a*) formed on an inside wrist portion (120) of the palm portion (10)**.

7. A goalkeeper's glove according to claim 1, wherein said extending flap (4) includes: a substrate sheet (41) protruding downwardly from the palm portion (10) to partially cover the strap (2); and an anti-slipping pad (42) fixed on the substrate sheet (41), whereby upon catching of a football on the palm portion (10) of the glove (1), the anti-slipping pad (42) will frictionally hold the ball (B) in cooperation with the wrinkle-releasing slot (3) having no wrinkle formed on the palm portion (10).

* * * * *